US010221585B2

(12) United States Patent
Cifelli et al.

(10) Patent No.: US 10,221,585 B2
(45) Date of Patent: Mar. 5, 2019

(54) VEHICLES PARKING IN MULTIPLE LEVELS AND METHOD FOR MANAGING MANEUVERING

(71) Applicant: Carmine Cifelli, Sao Paulo (BR)

(72) Inventors: Carmine Cifelli, Sao Paulo (BR); Vinicius Amorim, Sao Paulo (BR)

( * ) Notice: Subject to any disclaimer, the term of this patent is extended or adjusted under 35 U.S.C. 154(b) by 325 days.

(21) Appl. No.: 15/033,430

(22) PCT Filed: Oct. 29, 2014

(86) PCT No.: PCT/BR2014/000392
§ 371 (c)(1),
(2) Date: Apr. 29, 2016

(87) PCT Pub. No.: WO2015/061872
PCT Pub. Date: May 7, 2015

(65) Prior Publication Data

US 2016/0251867 A1 Sep. 1, 2016

(30) Foreign Application Priority Data

Oct. 31, 2013 (BR) ..... 102013028165

(51) Int. Cl.

| | |
|---|---|
| ***E04H 6/22*** | (2006.01) |
| ***E04H 6/18*** | (2006.01) |
| ***E04H 6/06*** | (2006.01) |
| ***E04H 6/12*** | (2006.01) |
| *E04H 6/20* | (2006.01) |

(52) U.S. Cl.
CPC ..... *E04H 6/181* (2013.01); *E04H 6/06* (2013.01); *E04H 6/12* (2013.01); *E04H 6/185* (2013.01); *E04H 6/20* (2013.01)

(58) Field of Classification Search
CPC ..... E04H 6/22
See application file for complete search history.

(56) References Cited

U.S. PATENT DOCUMENTS

| | | | | |
|---|---|---|---|---|
| 2,874,857 | A * | 2/1959 | Coursey | E04H 6/14 414/231 |
| 5,314,285 | A * | 5/1994 | Lai | E04H 6/22 414/236 |
| 5,707,199 | A * | 1/1998 | Faller | B65G 1/0478 414/21 |
| 6,974,293 | B2 * | 12/2005 | Stokes | E04H 6/22 414/227 |
| 8,897,913 | B2 * | 11/2014 | Luo | B65G 1/0478 700/213 |
| 2006/0018738 | A1 * | 1/2006 | Yen | E04H 6/22 414/234 |

* cited by examiner

*Primary Examiner* — Jonathan Snelting
(74) *Attorney, Agent, or Firm* — Hoglund & Pamias, PSC; Roberto J. Rios

(57) ABSTRACT

The present invention relates to a vehicles parking in multiple levels (1), which comprises a parking box (2); a base structure (3) and a lifting system (4); allowing the storing of vehicles in different levels in relation to the ground level, optimizing the use of the space; and to a method for managing maneuvering consisting of a system for optimizing the parking space and the vehicles parking in multiple levels (1).

12 Claims, 11 Drawing Sheets

VEHICLES PARKING IN MULTIPLE LEVELS AND METHOD FOR MANAGING MANEUVERING

FIELD OF THE INVENTION

The present invention relates to the field of buildings. More specifically to buildings for vehicles parking.

STATE OF ART

The increase in the number of circulating vehicles and the higher demand for parking spots in large urban centers led to the adoption of vertical solutions for parking places. The various models of parking lots, parking equipment and parking systems for this purpose can be classified into two main types: direct access and indirect access.

Direct access vertical parkings are characterized by the removal of the requested vehicle without the need of moving any previous vehicles, in other words, the transportation system directly access the target vehicle without moving non-requested vehicles. Similar to a regular ground parking, where there is a space for the parking spot and an exit passage for the vehicle, without the need of moving other vehicles that obstruct its way out. There are variations of this kind of model with different automatization degrees, going from manually operated to completely automated.

Vertical parkings of indirect access are characterized by the removal of the requested vehicle with the need of moving any previous vehicle; in other words, the transportation system needs to move non-requested vehicles to access the target vehicle. Similar to a regular ground parking, where there is only the space for the parking spot, it is necessary that a driver removes the vehicles that obstruct the removal of the requested vehicle. Both types of parking are built in a static building structure.

The existing vertical parkings of direct access are really efficient in the access operation of the vehicles; on the other hand, it allocates a relevant part of space to the vehicles' movement system. In this aspect, this parking system goes against its own purpose, which is to optimize the space once it uses a significant area destined to the movement operation and not to storage. In this way, those parking systems need a high amount of pavements to make the system viable. Patents EP0374104, U.S. Pat. No. 4,039,089; U.S. Pat. No. 5,487,636; and U.S. Pat. No. 5,478,182 relate to parking systems of this kind.

However, indirect access parkings prioritize a better volumetric occupation rate and, due to this, direct movement of the vehicles is precluded. Such movement occurs through different stages in function of the position of the target vehicle and the position of its neighbor vehicles. These systems require more elaborated mechanisms and an increased operational time.

Patent documents EP 0394378; US 20080075566 and U.S. Pat. No. 6,345,948 relate to indirect access parkings having multiple levels of parking spots.

OBJECTIVES OF THE INVENTION

It is an objective of the present invention to propose a vehicle parking that allows the automated storage in multiple levels in relation to the ground level and, with that, optimizing the use of the ground.

As a last objective of the invention, it is proposed a method for managing the movement of vehicles in parkings of multiple levels.

SUMMARY OF THE INVENTION

The present invention relates to multiple levels vehicle parkings comprising a parking box; a supporting base structure with locks, horizontal ground transportation and a lifting system. This parking allows the storage of vehicles in different levels in relation to the ground, optimizing, thus, the use of space.

The parking box can be stacked on a base structure, which allows the stacking of a set of boxes forming a stacking pile. The base structure allows the vehicles to remain at a determined elevation from the ground, allowing, thus, the horizontal movement of the boxes only at ground level.

Hereinafter, a supporting base structure with locks and a horizontal ground transportation will be called solely as a base structure and a set of boxes positioned on a base structure will be called a pile or a box pile. A group of piles positioned side by side along with a lifting system, will be called a line of piles or line of box piles, and a set of line of piles placed side by side will be called as vehicles parked in multiple levels.

The lifting system allows each parking box to be vertically moved. The vertical movement occurs by positioning the lifting system right below the parking box located at ground level, which is, then, lifted up to the first level above the ground and locks the supports of the base structure.

Opposite to the previously explained operation, the parking box is initially locked to the supports of the base structure at the first level above the ground level, until the lifting system is engaged to the box, thus, allowing opening the locks of the base system so that the lifting system moves the box back to the ground level. In other words, in this operation, the locks of the base structure are open first to allow only one parking box of the box pile to be moved by the lift to ground level and then, the locks of the base system are closes to lock the boxes on the first level. From this point, the parking box located at ground level can be freely moved horizontally with two different purposes: for moving the box to the destination place so the vehicle driver moves the vehicle out of the box or to occupy a temporary position at ground, allowing moving the other boxes.

BRIEF DESCRIPTION OF THE DRAWINGS

In order to obtain a total and complete understanding of the object of this invention, drawings are attached which reference is made as follows.

DETAILED DESCRIPTION OF THE INVENTION

Figure 1:
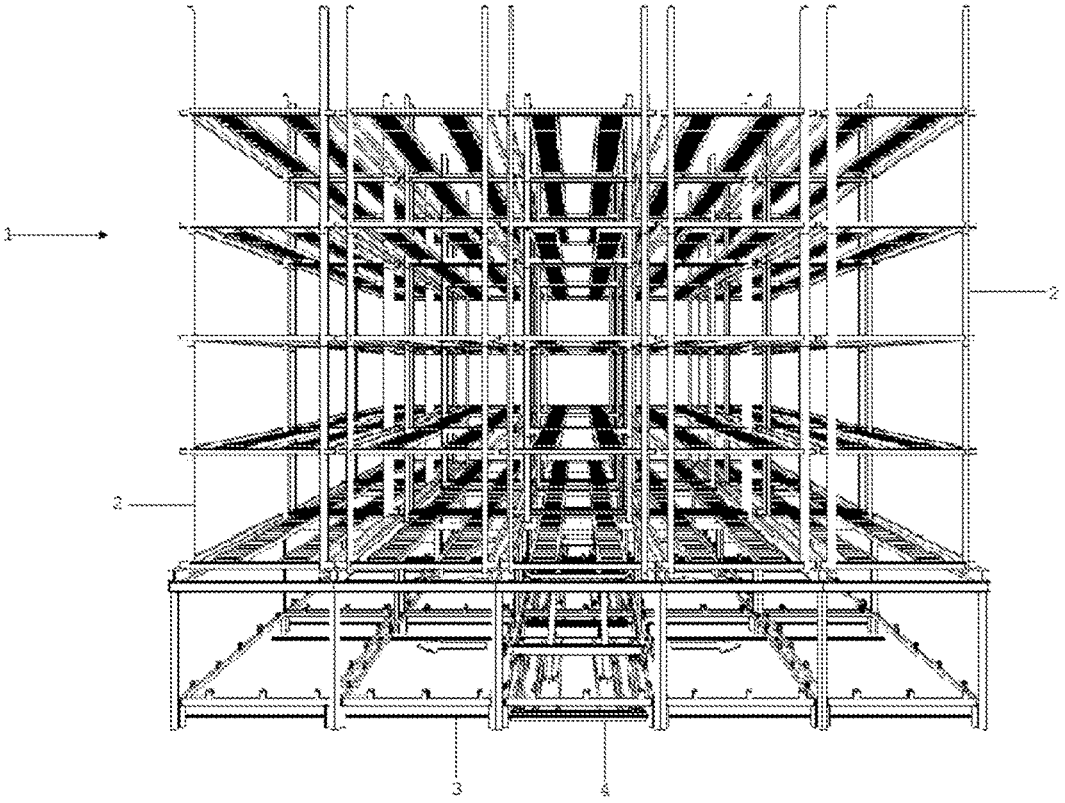
FIG. 1 shows the perspective view of an embodiment of the vehicles parking in multiple levels.
Figure 2:
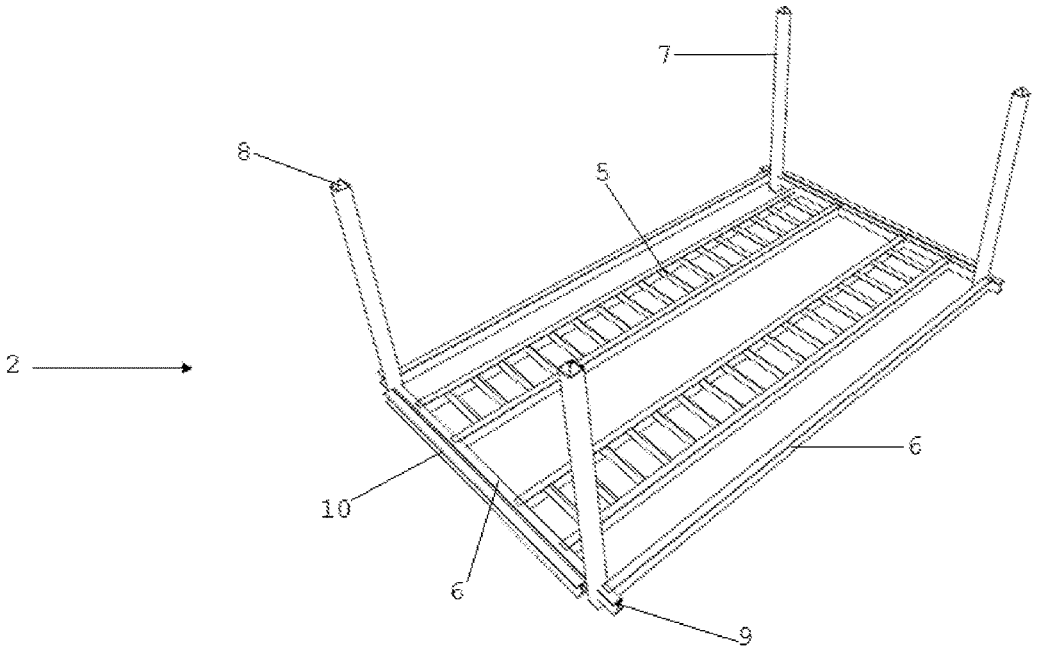
FIG. 2 is the perspective view of a parking box.
Figure 3:
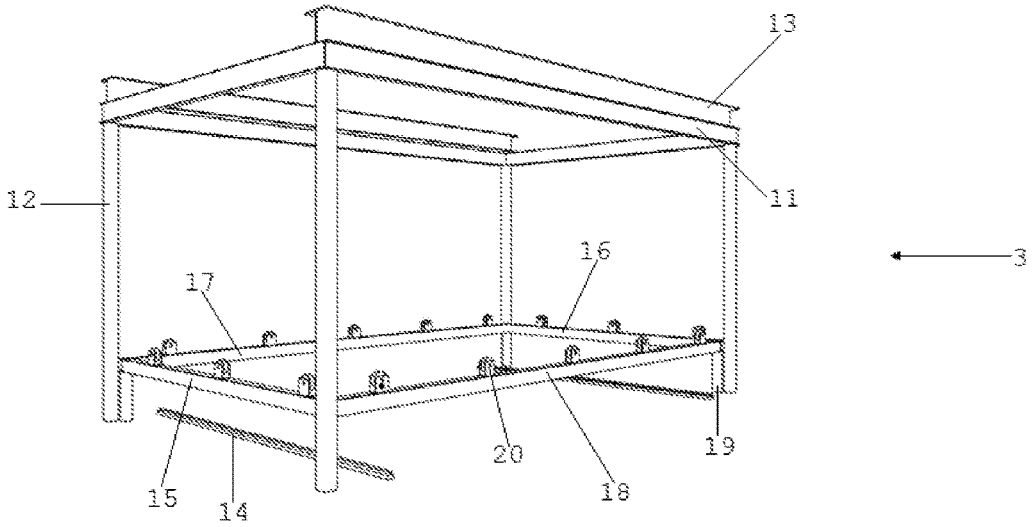
FIG. 3 is the perspective view of the base structure.
Figure 4:
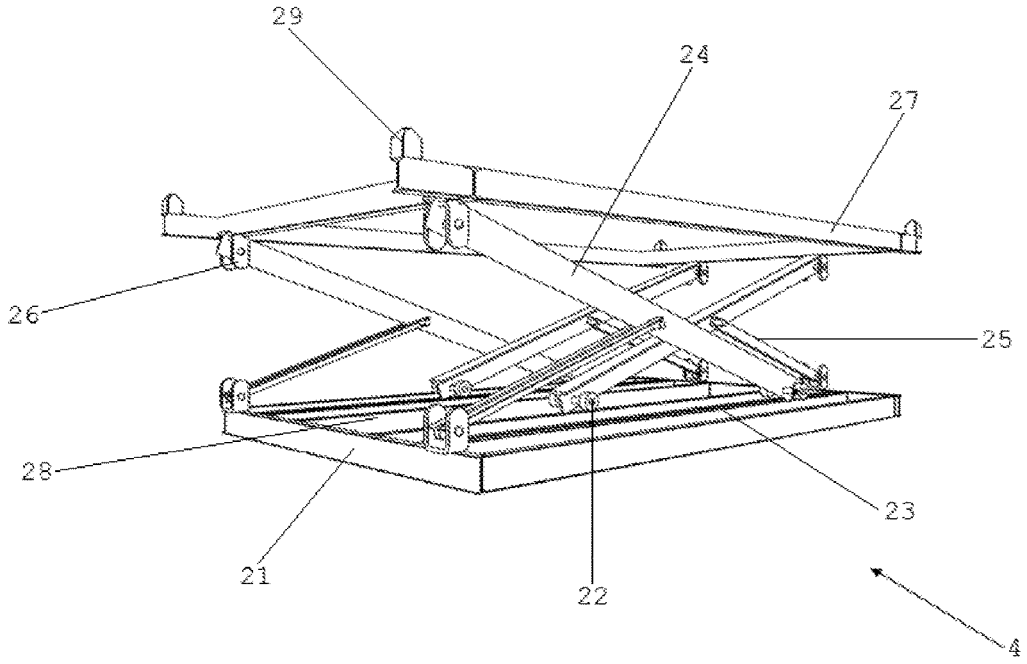
FIG. 4 shows the perspective view of the lifting system.

The multiple levels (1) parking for vehicles comprises a parking box (2); a base structure (3) and a lifting system (4) that allows storing vehicles in different levels in relation to ground level, optimizing the use of space.

For the purposes of this invention, the terms box and parking box refer to the same structure and can be used indistinctively throughout the specification, conveying the same meaning. The same applies to the plural of these terms.

Thus, the parking box (2) of the present invention is formed by two bases (5) which are suitable for receiving the wheels of the vehicle and have their ends coupled to the beams (6), which, in turn, are coupled to the columns (7) which are provided with engaging structures (8). The engaging structures (8) serve for guiding and ensure the correct fit between two adjacent boxes.

Preferably, the columns (7) are made of metallic tubes having a squared profile, wherein the engaging structure (8) is formed as crossed plates.

The terminal ends of the lateral beams (6) comprise a protrusion (9) suitable as a supporting point where the boxes will be supported by the base structure (3). Tracks (10) are coupled and provided around all of the parking box (2), allowing the parking box (2) to move in both directions during the horizontal movement.

The base structure (3) is formed by four fixed metallic beams (11) forming a framework that is supported by the metallic columns (12) coupled to the foundation on the ground level. Two movable beams (13) are coupled to the framework and can freely move sideways, in order to remain in an opened position that allows the free passage of the parking box (2) or in a closed position that allows supporting the boxes on the base structure (3). Tracks (14) are provided at the lower part of the base structure (3) for allowing movement of the lifting system (4).

A framework, formed by the beams (15), (16), (17) and (18) is placed within the base structure (3), said framework is supported by four small columns (19) and provided with rollers (20). Tracks (10) of the boxes (2) are provided to contact the rollers (20) so they can horizontally move when the electric motor, installed on the framework, accelerates or the brakes the parking box (2) in both directions during the horizontal movement. The electric motor is not part of the invention, thus, it was not illustrated and can be any electric engine according to the prior art.

The beams (15) and (16) are variably lifted a few centimeters and, when located on the highest position, actuation of the rollers (20) provided on the beams (15) and (16) are allowed and when located on the lowest position, actuation of the rollers is prevented, avoiding any interferences with the line of the rollers (20) provided on the beams (17) and (18).

The lifting system (4) comprises one lower framework (21) provided with rollers (22) that move along the tracks (23), allowing the lifting and lowering movements of the beam (24).

Each one of the beams (24) is connected to the rod (25) by its middle part; to the rollers (22) by its lower end and to the articulation (26) by its upper end, being the structure responsible for the lifting and lowering of the lifting system (4). The articulation (26) connects the upper framework (27) to the beam (24). The rollers have their movement horizontally restricted by the guides (28).

The upper framework (27) has, on its four ends, the engaging structure (29) that allow engaging the boxes (2) during the lifting and lowering of the box (2), placing them on the lifting system (4).

Figure 5:
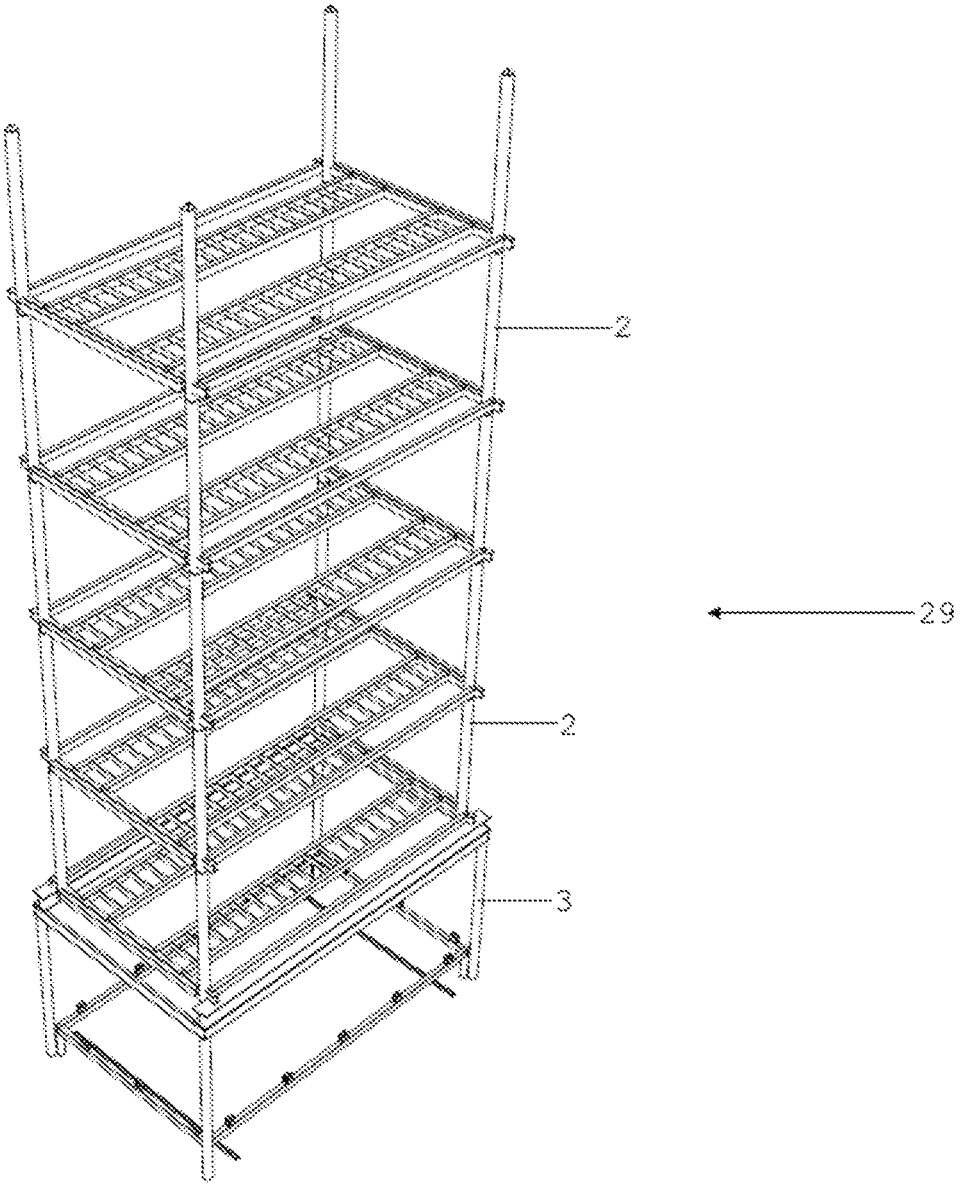
FIG. 5 shows the perspective view of a box pile on the base structure.

FIG. 5 shows a box pile (29), which is formed by stacking multiple parking boxes (2) on top of the base structure (3) and the lifting system (4). As can be seen in this figure, contrary to the direct and indirect parking systems of the prior art, the present invention does not need a building of fixed structures for supporting the boxes above ground level, as once the first parking box (2) of the box pile is directly positioned on the base structure (3) the remainder boxes (2) of the pile are positioned on top of each other.

Figure 6:
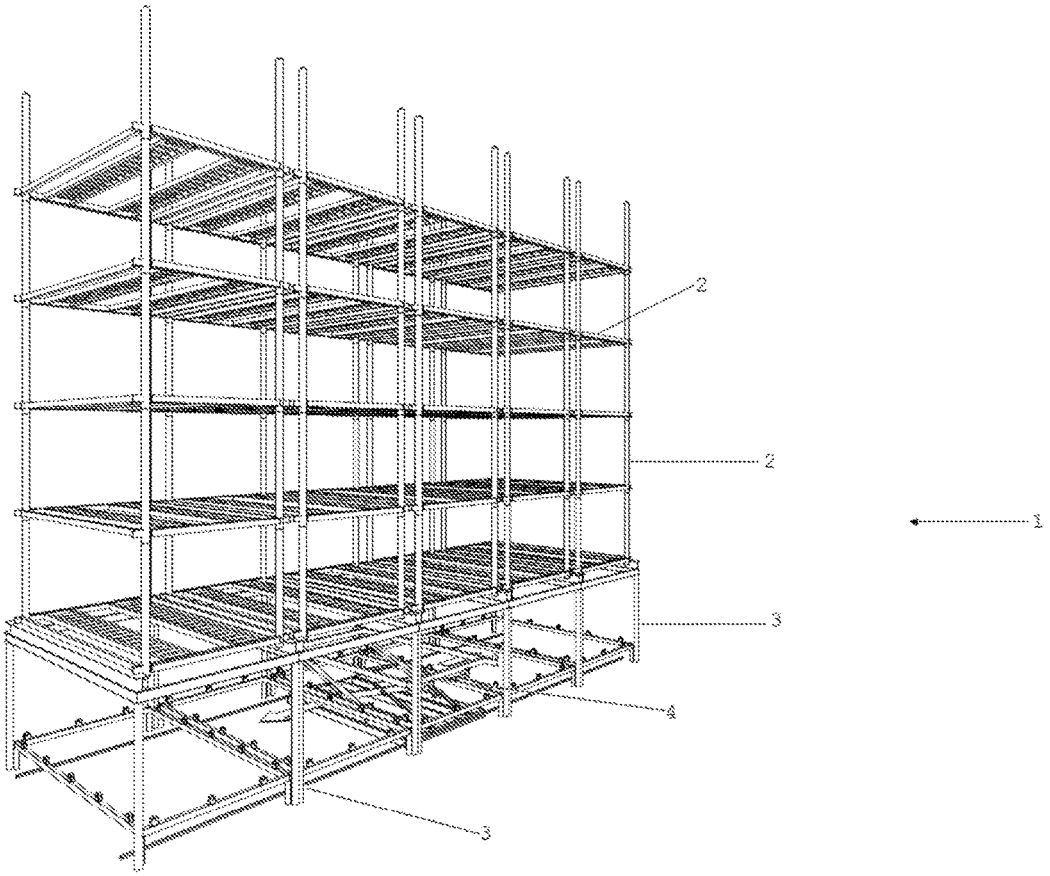
FIG. 6 shows the perspective view of an embodiment of the set of piles.

In an embodiment of the invention, a line of piles comprises a set of box piles (29) horizontally arranged side-by-side, as can be seen on FIG. 6. When the lifting system (4) is on the lowering position, it can horizontally move through the set of box piles on the tracks (14) of the base structure (3) solely in a longitudinal direction of the structure as showed in FIG. 12.

Figure 7:
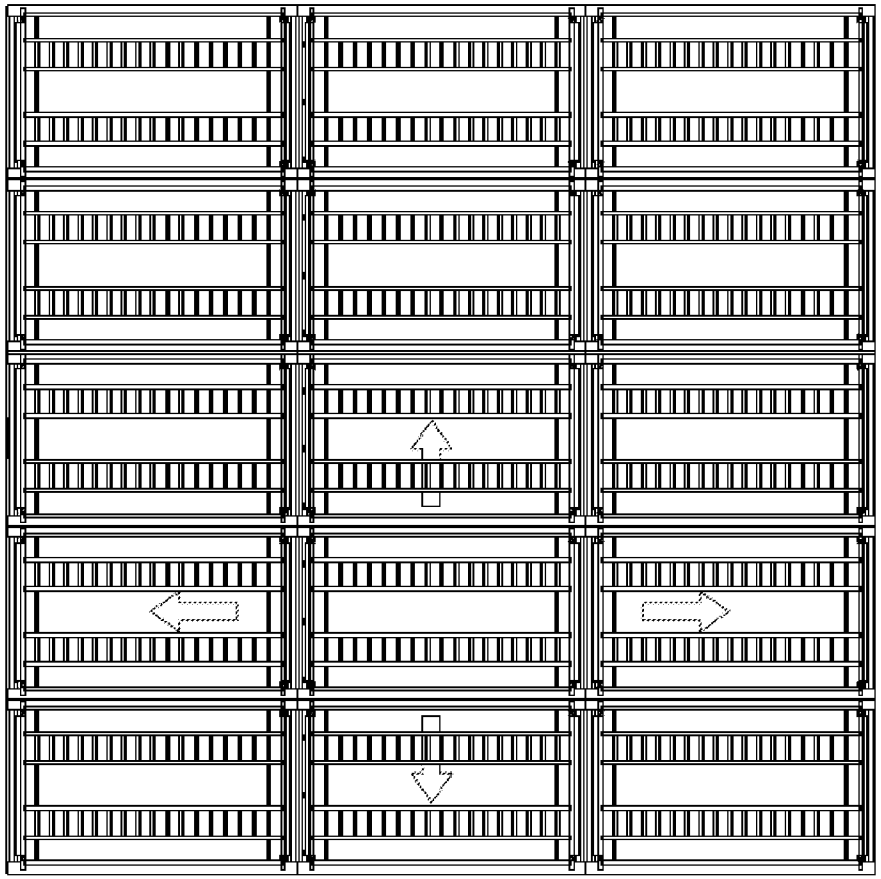
FIG. 7 shows a top view of the movement degrees of freedom of the parking box at ground level.
Figure 8:
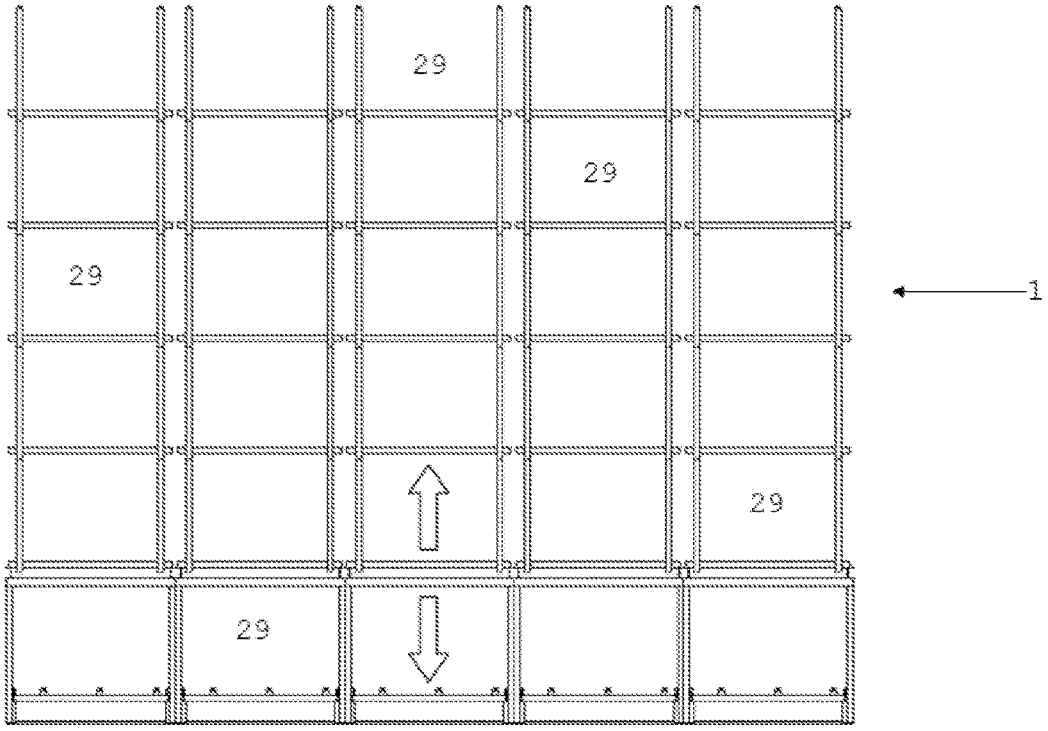
FIG. 8 is the sectional view and shows the movement degrees of freedom of the boxes at ground level and upper levels.

FIG. 7 shows an alternative embodiment of the invention, in which the lines of the box piles (29) are arranged side-by-side to form a complete multiple levels vehicles parking (1). FIG. 8 shows the freedom of movement of the boxes (2) when they are positioned on ground level, which is the ground of the base structure (3).

The invention also relates to a method for vehicle movement management consisting of a system for optimizing parking space and the multiple levels vehicles parking (1).

The method for managing vehicle movement organizes a sequence of movements of the boxes (2) forming the parking (1), in a way that allows introducing a vehicle into the parking, as well as its removal in a reduce amount of time.

In this invention, the sequence of movements of the boxes (2) and the movements are synonyms and can herein be used indiscriminately and independently, referring to the same feature of this object of the invention.

Figure 9:
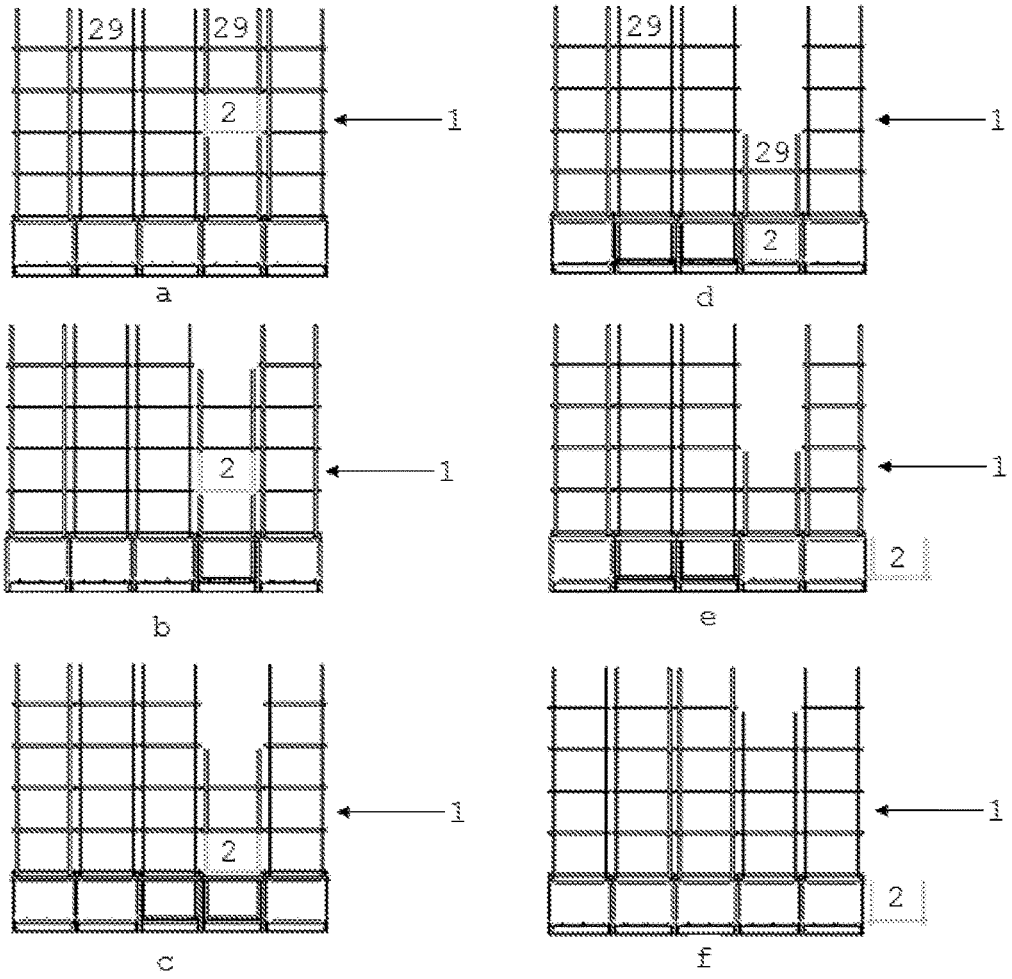
FIG. 9 represents the sectional view and shows the stages of an exit movement of a vehicle.

FIG. 9 shows a sequence of movements performed by the system for moving the boxes (2) during a removal operation of a vehicle. In this figure, an embodiment is illustrated showing the way a vehicle is removed from the multiple levels vehicles parking (1). This movement consists of a sequence of steps for lowering the boxes of the box pile (29), as illustrated in (a) to (d), followed by the horizontal movement of the parking box (2) at the bottom of this pile (29), as indicated from (d) to (e). In this way, all of the boxes (2) positioned under the target box will be placed on the ground level of the base structure (3) until the target box (2) reaches the lower level, at ground level. Thus, the target parking box (2) with the vehicle is directed to the end of the parking in which a driver can remove it. At the same time, the boxes (2) that were spread on the ground level of the movable structure will be moved back to the base of the pile in a position where it will be lifted to reconstitute the pile, as in the final disposal position shown in (f).

Figure 10:
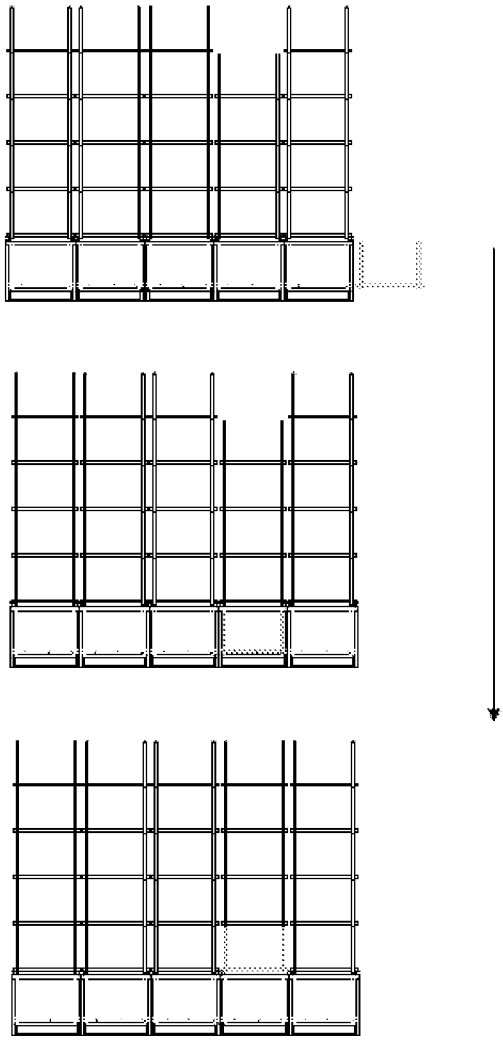
FIG. 10 shows the sectional view and illustrates the stages of an entry movement of a vehicle.

FIG. 10 shows a vehicle being entered into the parking. After being left by the driver inside the box (2), the vehicle will be directed by the horizontal movement system to the base of a pile where it will be lifted by the lifting system (4). Once lifted, the box is supported on the beams—locks of the base structure (3) and it is stored under other boxes previously positioned on the pile.

Figure 11:
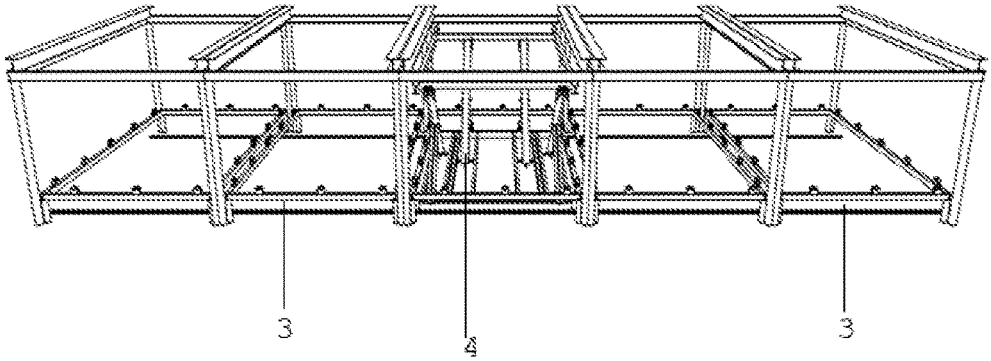
FIG. 11 shows the perspective view of the lifting system in lifted position.

FIG. 11 shows a set of base structures (3) disposed side-by-side with the lifting system (4) in a lifted position.

Figure 12:
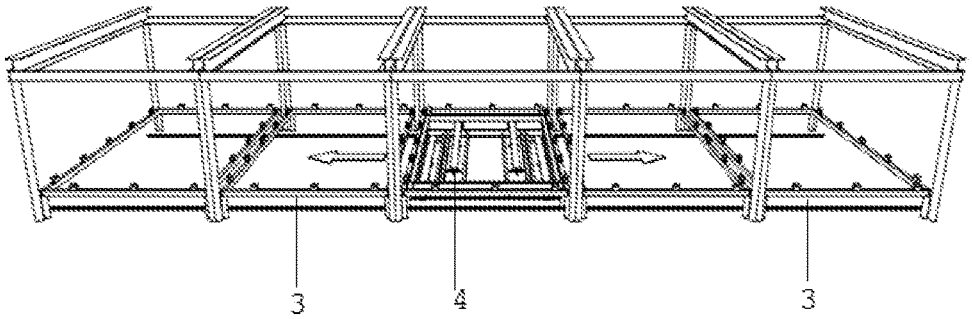
FIG. 12 represents the perspective view of the lifting system in lowered position and shows the degrees of freedom of the horizontal movement of the lift at ground level.

However, in FIG. 12, the lifting system (4) is on a lowered position where it can freely move in the directions indicated by the arrows.

In this way, the present invention refers; therefore, to a multiple levels vehicle parking for indirect storage of vehicles that prioritizes a greater volume usage. The main difference between this invention and other parking of the indirect types is that the present invention does not need a static building structure, since its structure consists of independent boxes (2) and base structures (3). Despite the fact that the system of the invention has a simpler installation process, it can also be uninstalled and, in this way, it is possible to relocate to other places, thus, allowing the use of the structure of multiple levels vehicle parking according to the need and without losing the investment already done.

The present invention also allows varying the capacity of parking spots in a parking, by adding or removing the boxes (2) based on local demand variations for parking spaces.

Furthermore, the boxes (2) and the base structure (3) do not have mechanical mechanisms, facilitating and reducing the manufacturing and installation costs.

Another advantage of the invention is that the operation of the multiple levels vehicle parking (1) is based on a very simple principle that enables several different movement combinations of the boxes (2), creating a great variety of moving options. Due to this fact, the present invention allows the use of resources for optimizing the process which can be performed in a customized way for each different user flow scenario, providing efficiency in the occupation and, at the same time by using computational intelligence, the invention mitigates the major deficiency of the indirect systems, which is an increased moving time.

Finally, even though the invention has been broadly disclosed, it is obvious for those skilled in the art that several alterations and modifications can be made and that those alterations will be covered by the scope of the invention.

The invention claimed is:

1. A multiple level parking for vehicles comprising:

a plurality of parking boxes (2), wherein each parking box comprises:

a pair of horizontal bases (5), configured to receive wheels of a vehicle;

a pair of horizontal beams (6), wherein ends of said pair of horizontal bases (5) are perpendicularly coupled to said pair of horizontal beams (6);

tracks (10) provided below said horizontal beams (6) allowing horizontal movement of the parking box (2);

a plurality of vertical columns (7), each positioned at ends of said pair of horizontal beams (6), wherein an engaging structure (8) is provided at an upper end of each vertical column of said plurality of vertical columns (7);

a plurality of base structures (3), wherein each base structures comprises:

a plurality of horizontal fixed beams (11) forming a framework;

a plurality of vertical columns (12) supporting at their upper ends said framework, wherein said plurality of vertical columns (12) are secured to the ground;

two movable beams (13) positioned on top of said framework and being configured to move into an open position allowing vertical passage of a parking box (2) and to move into a close position where said parking box (2) is supported on said base structure (3);

tracks (14) located at a lower part of said base structure;

at least one lifting system (4), wherein each lifting system (4) comprises:

a lower framework (21) and rollers (22) rolling on tracks (23) provided on said lower framework (21) to allow lifting and lowering of an upper framework (27), wherein said lifting system (4) horizontally moves on said tracks (14).

2. The multiple level parking according to claim 1, wherein the vertical columns (7) of said parking boxes (2) are provided as metallic tubes of squared profile.

3. The multiple level parking according to claim 1, wherein the ends of said pair of horizontal beams (6) have protrusions (9) provided to support the parking box (2) on said base structure (3).

4. The multiple level parking according to claim 1, wherein the base structure (3) further comprises:

an inner framework having a pair of horizontal inner beams (15,16) and a pair of horizontal inner side beams (17,18) perpendicularly coupled to said pair of horizontal inner beams (15,16) at their respective ends, said inner framework being supported by vertical columns (19) having a height smaller than said plurality of vertical columns (12); and inner framework rollers (20) positioned along a top surface of said pair of horizontal inner beams (15,16) and said pair of horizontal inner side beams (17,18), wherein the tracks (10) of the parking box (2) are in contact with said inner framework rollers (20) allowing horizontal movement of the parking box (2).

5. The multiple level parking according to claim 4, wherein said pair of horizontal inner beams (15,16) are selectively moved vertically so that the inner framework rollers (20) provided on said pair of horizontal inner beams (15,16) are:

actuated when said pair of horizontal inner beams (15,16) are positioned above said pair of horizontal inner side beams (17,18); and not actuated when said pair of horizontal inner beams (15,16) are positioned at the same horizontal level of said pair of horizontal inner side beams (17,18) avoiding any interference with the inner framework rollers (20) provided on said pair of horizontal inner side beams (17,18).

6. The multiple level parking according to claim 1, wherein said lifting system (4) further comprises:

lifting beams (24), each one having one of said rollers (22) at an end and an articulation element (26) at another end;

a rod (25) coupled to said lifting beam (24) and to said lower framework (21), said articulation element (26) being coupled to said upper framework (27) so that movement of said lifting beam (24) allows vertical movement of the upper framework (27); and guides (28) provided on said lower framework (21) to prevent said rollers (22) from moving vertically.

7. The multiple level parking according to claim 6, wherein said upper framework (27) comprises a plurality of engaging structures (29) provided on a top surface of said upper framework (27) so that said engaging structures (29) engage to a lower end of said plurality of vertical columns (7) when the parking boxes (2) are moved vertically.

8. The multiple level parking according to claim 1, wherein providing a plurality of said parking boxes (2) stacked on a base structure (3) and a lifting system (4) form a box pile (29).

9. The multiple level parking according to claim 8, further comprising a plurality of individual box piles (29).

10. A method for managing movement of vehicles on a multiple level parking, the method comprising:

vertically moving down individual parking boxes (2) of a plurality of stacked parking boxes (2) into a first base structure (3) until a target parking box (2) supporting a target vehicle is moved into said first base structure (3); and horizontally moving in sequence to other base structures (3) positioned contiguous to said first base structure (3) any parking boxes (2) vertically moved down into said first base structure (3) prior to moving said target parking box (2) into said first base structure (3).

11. The method of claim 10, further comprising: horizontally moving the target parking box (2) to an area for a target vehicle removal once said target parking box (2) is vertically moved into said first base structure (3).

12. The method of claim 10, further comprising:

horizontally moving back into said first base structure (3) each parking box (2) that was previously moved down into said first base structure (3); and vertically moving up each parking box (2) until said plurality of stacked parking boxes (2) are completely stacked above said first base structure (3).

* * * * *